US011015848B2

(12) United States Patent
Bilbow, Jr.

(10) Patent No.: US 11,015,848 B2
(45) Date of Patent: May 25, 2021

(54) AXIAL FLOW COMPRESSOR FOR HVAC CHILLER SYSTEMS

(71) Applicant: Danfoss A/S, Nordborg (DK)

(72) Inventor: William M. Bilbow, Jr., Tallahassee, FL (US)

(73) Assignee: Danfoss A/S

( * ) Notice: Subject to any disclaimer, the term of this patent is extended or adjusted under 35 U.S.C. 154(b) by 81 days.

(21) Appl. No.: 16/060,433

(22) PCT Filed: Apr. 20, 2017

(86) PCT No.: PCT/US2017/028490
§ 371 (c)(1),
(2) Date: Jun. 8, 2018

(87) PCT Pub. No.: WO2017/184804
PCT Pub. Date: Oct. 26, 2017

(65) Prior Publication Data
US 2019/0049161 A1 Feb. 14, 2019

Related U.S. Application Data

(60) Provisional application No. 62/325,210, filed on Apr. 20, 2016, provisional application No. 62/334,218, filed on May 10, 2016.

(51) Int. Cl.
*F25B 31/00* (2006.01)
*F04D 19/02* (2006.01)
(Continued)

(52) U.S. Cl.
CPC ..... *F25B 31/006* (2013.01); *F04B 35/04* (2013.01); *F04B 39/06* (2013.01); *F04B 39/066* (2013.01);
(Continued)

(58) Field of Classification Search
CPC ..... F04D 19/00; F04D 19/002; F04D 19/007; F04D 27/004; F04D 27/009; F04D 27/06;
(Continued)

(56) References Cited

U.S. PATENT DOCUMENTS 1,626,621 A * 5/1927 Middendorf ..... F25B 1/04 415/199.4
2,084,462 A * 6/1937 Stalker ..... F04D 27/0215 415/115
(Continued)

FOREIGN PATENT DOCUMENTS

EP 0148102 A2 7/1985
GB 658156 * 10/1951

OTHER PUBLICATIONS

International Preliminary Report on Patentability for International Application No. PCT/US2017/028490 dated Nov. 11, 2018.
(Continued)

*Primary Examiner* — Charles G Freay
(74) *Attorney, Agent, or Firm* — Carlson, Gaskey & Olds, P.C.

(57) ABSTRACT

One exemplary embodiment of this disclosure relates to a refrigerant compressor for use in a chiller system. The compressor includes an electric motor arranged upstream of a stage of a compressor in the main refrigerant flow path.
(Continued)

This disclosure also relates to an axial flow compressor of a relatively high capacity, and a recirculation feature for the same.

3 Claims, 3 Drawing Sheets

(51) Int. Cl.

| | |
|---|---|
| ***F04D 25/06*** | (2006.01) |
| ***F25B 1/053*** | (2006.01) |
| ***F04B 35/04*** | (2006.01) |
| ***F04B 39/06*** | (2006.01) |
| ***F04D 29/58*** | (2006.01) |
| ***F04D 27/00*** | (2006.01) |
| ***F04D 19/00*** | (2006.01) |

(52) U.S. Cl.
CPC ..... *F04D 19/007* (2013.01); *F04D 19/02* (2013.01); *F04D 25/06* (2013.01); *F04D 27/009* (2013.01); *F04D 29/5806* (2013.01); *F25B 1/053* (2013.01); *F05D 2250/51* (2013.01); *F25B 2500/28* (2013.01)

(58) Field of Classification Search
CPC ..... F04D 29/5806; F04D 27/0215; F04D 27/0238; F05D 2250/51; F04B 35/04; F04B 39/06; F04B 39/065; F25B 31/006; F25B 1/053; F25B 2500/28
USPC ..... 417/371
See application file for complete search history.

(56) References Cited

U.S. PATENT DOCUMENTS

| | | | | | |
|---|---|---|---|---|---|
| 2,458,730 | A * | 1/1949 | Ponomareff | F25B 31/026 | 417/423.14 |
| 2,956,732 | A * | 10/1960 | Stalker | F04D 27/0215 | 415/181 |
| 3,719,426 | A * | 3/1973 | Friberg | F04D 19/022 | 415/116 |
| 4,147,473 | A * | 4/1979 | Bufalov | F04D 27/0261 | 417/247 |
| 4,780,061 | A * | 10/1988 | Butterworth | F04C 29/026 | 184/6.22 |
| 5,136,854 | A | 8/1992 | Abdelmalek | | |
| 5,833,433 | A * | 11/1998 | May | F02C 7/045 | 415/115 |
| 6,261,070 | B1 | 7/2001 | Johnson | | |
| 10,184,481 | B2 * | 1/2019 | Brasz | F25B 1/053 | |
| 2002/0124580 | A1 | 9/2002 | Suitou et al. | | |
| 2007/0297912 | A1 * | 12/2007 | Reuter | F04D 25/06 | 416/93 R |
| 2013/0011280 | A1 * | 1/2013 | Nakayama | F04D 19/02 | 417/410.1 |
| 2013/0121807 | A1 * | 5/2013 | Micheli | F04D 19/028 | 415/58.7 |
| 2016/0245305 | A1 * | 8/2016 | Kimura | F01D 5/143 | |
| 2016/0290363 | A1 * | 10/2016 | Nishihara | F04D 29/321 | |

OTHER PUBLICATIONS

International Search Report and Written Opinion for the International Application No. PCT/US17/28490 dated Jul. 20, 2017.

* cited by examiner

AXIAL FLOW COMPRESSOR FOR HVAC CHILLER SYSTEMS

RELATED APPLICATIONS

This application claims the benefit of U.S. Provisional Application No. 62/325,210, filed Apr. 20, 2016, and U.S. Provisional Application No. 62/334,218, filed May 10, 2016, both of which are herein incorporated by reference in their entirety.

BACKGROUND

This disclosure relates to an HVAC chiller system having an axial flow compressor with a cold end electric motor drive.

Refrigerant compressors are used to circulate refrigerant in a chiller via a refrigerant loop. Refrigerant loops are known to include a condenser, an expansion device, and an evaporator. The compressor compresses the fluid, which then travels to a condenser, which in turn cools and condenses the fluid. The refrigerant then goes to an expansion device, which decreases the pressure of the fluid, and to the evaporator, where the fluid is vaporized, completing a refrigeration cycle.

Many refrigerant compressors are centrifugal compressors and have an electric motor that drives at least one impeller to compress refrigerant. Fluid flows into the impeller in an axial direction, and is expelled radially from the impeller. The fluid is then directed downstream for use in the chiller system. Some refrigerant loops provide motor cooling by conveying refrigerant from the condenser to the motor. The refrigerant conveyed to the motor from the condenser is additional mass flow that the compressor must compress which provides no chiller benefit.

DETAILED DESCRIPTION

Figure 1:
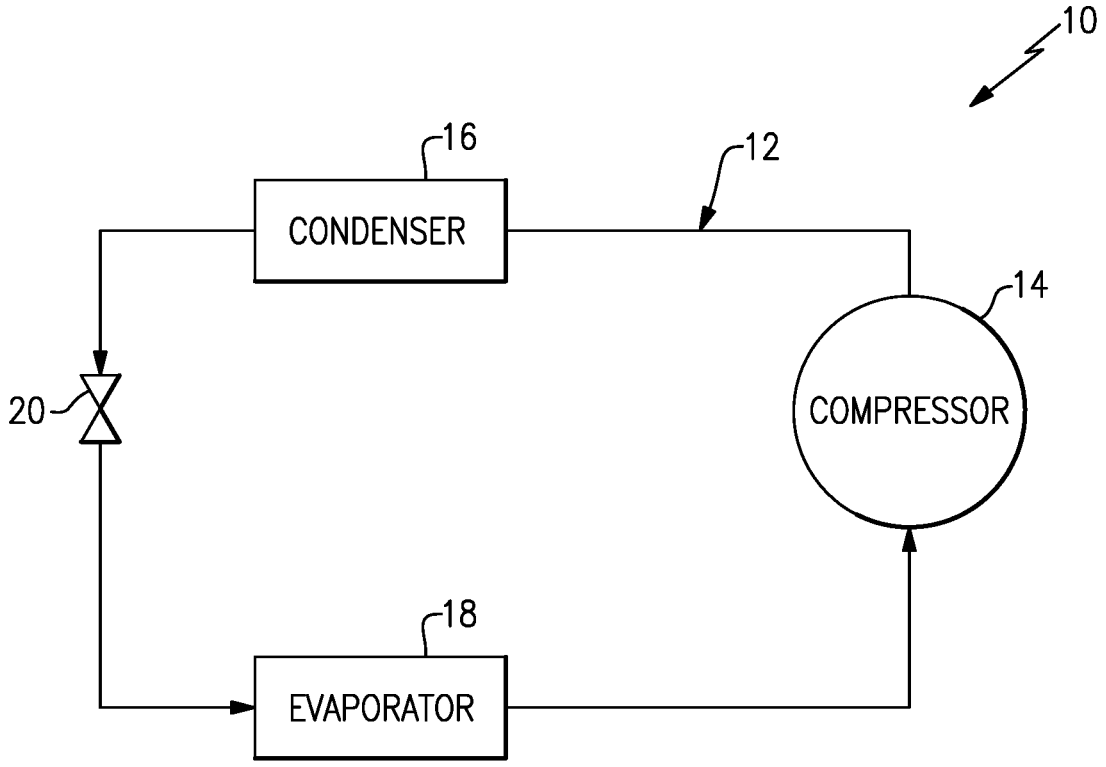
FIG. 1 schematically illustrates a refrigerant system.

FIG. 1 illustrates a refrigerant system 10. The refrigerant system 10 includes a main refrigerant loop, or circuit, 12 in communication with a compressor 14, a condenser 16, an evaporator 18, and an expansion device 20. This refrigerant system 10 may be used in a chiller, for example. While a particular example of the refrigerant system 10 is shown, this application extends to other refrigerant system configurations. For instance, the main refrigerant loop 12 can include an economizer downstream of the condenser 16 and upstream of the expansion device 20.

Figure 2:
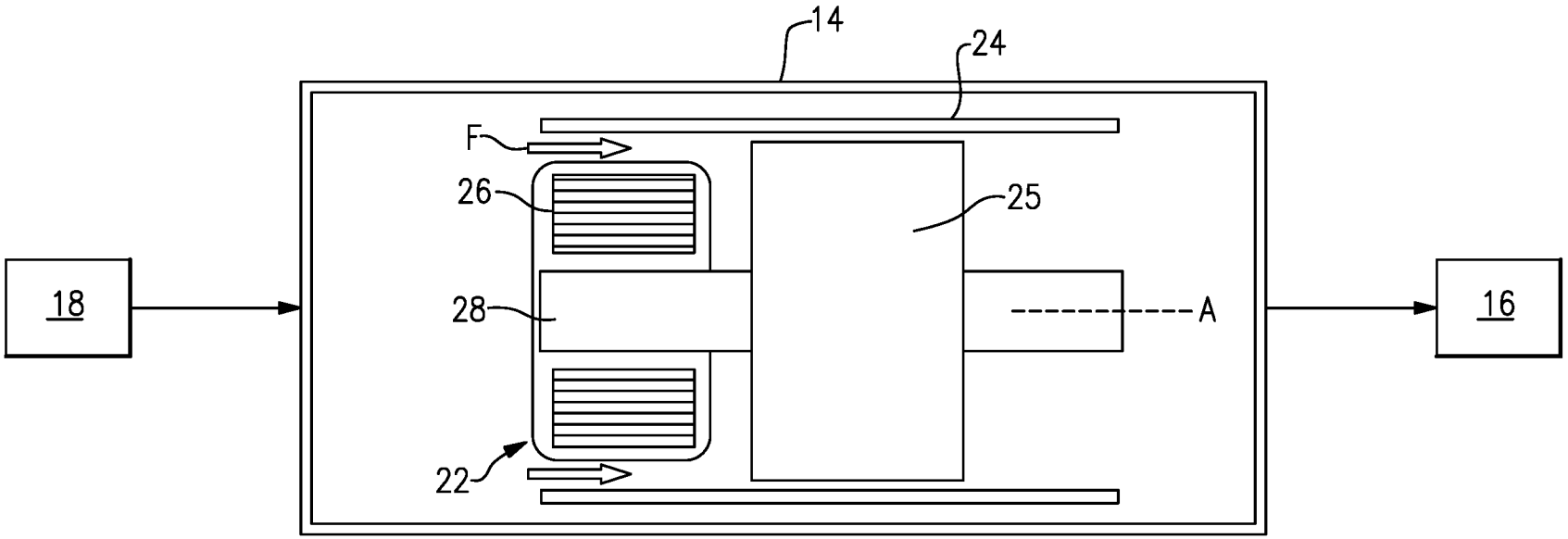
FIG. 2 schematically illustrates a compression arrangement including a cold end electric motor drive.

FIG. 2 schematically illustrates an example refrigerant compressor arrangement according to this disclosure. In this example, the compressor 14 has at least one compression stage 25 along a rotor that is driven by an electric motor 22. The compression stage 25 can be provided by the arrangement of FIG. 3, for example, which includes a plurality of arrays of blades 44 and vanes 46.

With continued reference to FIG. 2, the compressor 14 includes a housing 24, which encloses the motor 22. The housing 24 may comprise one or more pieces. The motor 22 rotationally drives at least one compression stage 25 about an axis A to compress refrigerant. In some embodiments, the compressor 14 includes two stages. However, it should be understood that this disclosure extends to compressors having one or more stages. Example refrigerants include chemical refrigerants, such as R-134a and the like.

The motor 22 comprises a stationary stator 26 and a rotor 28. The compression stage 25 of the compressor 14 is oriented along the rotor 28, and are driven directly by the rotor 28. In some embodiments, the rotor 28 is integral with at least one stage of the compressor, namely at least one rotor disc of the compressor. The motor 22 may be driven by a variable frequency drive. The housing 24 establishes a main refrigerant flow path, which is a boundary for a flow of working fluid F. In particular, the housing 24 establishes an outer boundary for the main refrigerant flow path.

The motor 22 is oriented axially upstream of the compression stage 25. In other words, the motor 22 is axially closer to the suction or cold-end of the compressor 14 than the compression stage 25. In this way, the working fluid F within the main refrigerant flow path enters the compressor 14 and passes over all perimeter surfaces of the motor 22, including around the outer diameter, fore and aft surfaces of the stator 26, as well as the narrow gap between the stator 26 and the rotor 28. As the motor 22 powers the compressor 14, it radiates heat which is transferred to the incoming working fluid F. Positioning the motor 22 upstream of the compressor 14 provides cooling of the motor 22, and thus may eliminate the need for motor cooling control or a motor cooling refrigerant loop. Elimination of a motor cooling refrigerant loop may result in a lower total mass flow required, as all mass flow used for cooling the motor 22 is used for chiller capacity. Further, elimination of a motor cooling control may improve motor life due to reduced thermal cycling on the motor 22.

Additionally, as the motor 22 is cooled, the working fluid F absorbs heat from the motor 22, which can improve the overall efficiency and performance of the compressor 14 by reducing the magnitude of inlet refrigerant superheat required for compressor performance and life. For instance, some known refrigerant systems can have liquid carryover when the refrigerant is not completely superheated going in to the compressor 14. Any liquid in the refrigerant prior to the compressor 14 can have detrimental effects on the compressor 14, such as causing imbalance on the stages, which could overload or damage the bearings. Any liquid carryover also requires higher power from the compressor 14. Positioning the motor 22 immediately upstream of the compressor stages reduces liquid carryover at the compression section downstream of the motor, and thus reduces the detrimental effects of liquid carryover. Because the refrigerant superheat can be reduced to very close to saturated vapor, heat from the motor 22 essentially boils any trace liquid in the refrigerant, known as liquid carryover, that has left the evaporator 18 before the refrigerant enters the stages of the compressor 14. This reduction in liquid carryover provides improved refrigerant cycle efficiency.

Figure 3:
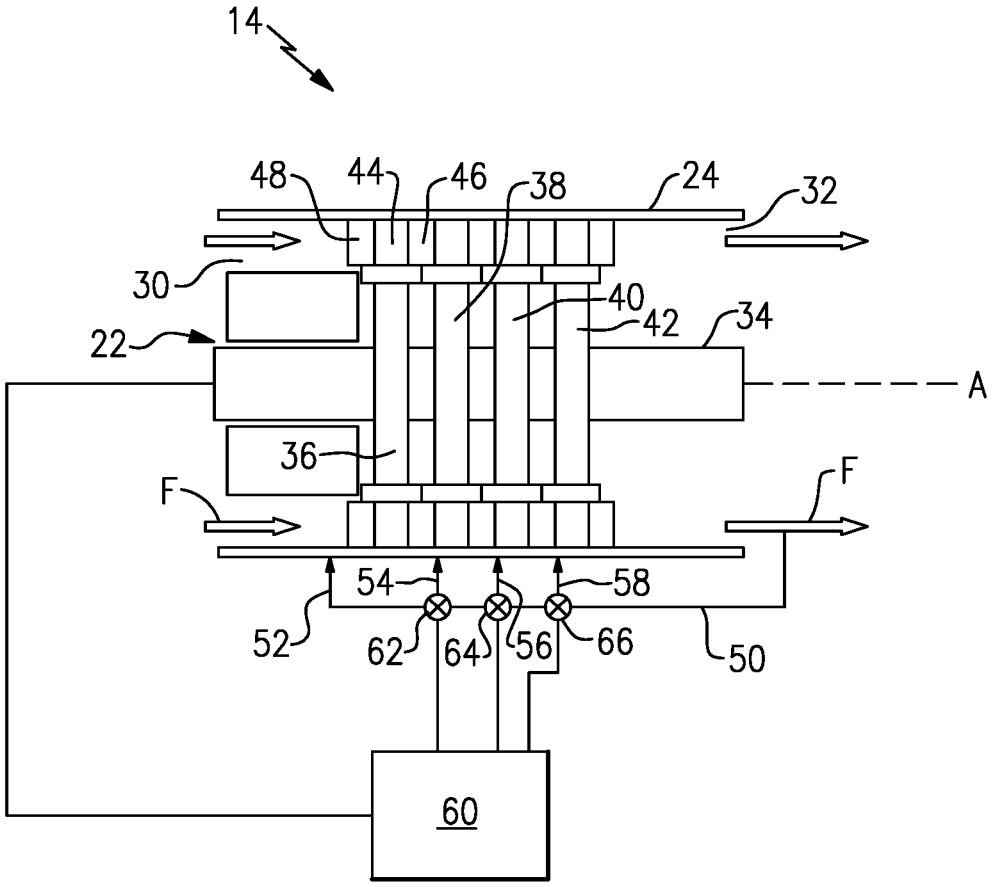
FIG. 3 schematically illustrates one embodiment of the detail associated with the compression arrangement of FIG. 2.

FIG. 3 schematically illustrates one embodiment of the detail of the compressor arrangement of FIG. 2. FIG. 3 schematically illustrates the detail of the compression stage 25, and in particular illustrates an example flow recirculation feature of the compressor 14.

The compressor 14 is an axial flow compressor, meaning that the axial flow compressor 14 includes an inlet 30 and an outlet 32 axially downstream of the inlet 30. A flow of working fluid F is configured to flow along a main flow path between the inlet and outlet 30, 32. The working fluid F is configured to flow principally in an axial direction, which is parallel to the axis of rotation A of the compressor 14. Specifically, the working fluid is configured to flow principally in a direction parallel to the axis of rotation of the shaft 34. The shaft 34 may be a separate component directly connected to the rotor 28 (FIG. 2), or may be provided by the rotor 28 itself.

The compressor 14 includes a plurality of rotor discs 36, 38, 40, 42 connected to the shaft 34. Rotation of the shaft 34 rotates the rotor discs 36, 38, 40, 42 about the axis of rotation A. While four discs are illustrated, this disclosure could extend to compressors having one or more discs. The shaft 34 is driven by the motor 22 in this example. While the motor 22 is shown as a cold end motor, such as that of FIG. 2, this disclosure could extend to other motor arrangements. The motor 22 may be cooled by refrigerant upstream of the rotor discs 36, 38, 40, 42. Further, the shaft 34 may be supported by magnetic bearings.

Each of the discs 36, 38, 40, 42 is connected to an array of rotor blades 44. Each array of blades 44 is configured to provide a compression ratio at peak efficiency within a range between 1.3 and 2.4. In one example, the height of each of the blades 44 in the first stage (closest to the inlet), from root to tip, is within a range of about 0.375 inches to 2 inches (about 1.9 cm to 5.08 cm). This blade size provides a relatively small polar moment of inertia on the shaft 34, which reduces the loads exerted by the shaft 34 on magnetic bearings, for example. Thus, the magnetic bearings supporting the shaft 34 may be relatively small, which leads to a reduced compressor size. In a further example, the blades could include tip treatments, such as shrouds. The tip treatments help in managing axial compression blade tip performance loss. The compressor 14 may include active or passive tip refrigerant flow control.

Downstream of each array of blades 44 is a corresponding array of stationary stator vanes 46. The vanes 46 are configured to remove the angular flow component imparted by the blades 44, and restore the axial flow direction as the working fluid F is directed downstream within the compressor 14. Together, pairs of the arrays of blades 44 and vanes 46 provide a single compression stage. While four compression stages are illustrated, this disclosure extends to compressors having one or more compression stages.

Upstream of the first rotor disc 36, the compressor 14 may include an array of inlet guide vanes 48. In this example, the inlet guide vanes 48 are stationary. The inlet guide vanes 48 are arranged to improve system efficiency and stability by imparting either a rotational velocity component to manage the first stage incidence angle, or to expand the working fluid F to a higher specific volume, or both.

The compressor 14 may also include a flow recirculation feature to manage surge/stall conditions. In this example, the compressor 14 includes a recirculation flow path 50 configured to selectively recirculate a portion of the working fluid F from a location adjacent the outlet 32 to an upstream location.

In this disclosure, the upstream location may include a location upstream of the inlet guide vanes, at 52. The upstream location may also include an inter-stage location 54, 56, 58 immediately downstream of the first stage, second stage, or third stage, respectively. A control unit 60 is configured to command a plurality of valves 62, 64, 66 provided in the recirculation flow path 50 to selectively introduce the working fluid from the recirculation flow path 50 to one or more of the upstream locations 52, 54, 56, 58. It should be understood that fluid in the recirculation flow path can be introduced to any one, or any combination, of the upstream locations 52, 54, 56, 58.

The control unit 60 includes electronics, software, or both, to perform the necessary control functions for operating the compressor 14, including operating the motor 22 and/or the valves 62, 64, 66. Although it is shown as a single device, the control unit 60 may include multiple controllers in the form of multiple hardware devices, or multiple software controllers within one or more hardware devices.

The recirculation flow path 50 could be incorporated into the housing 24 of the compressor 14. The fluid in the recirculation flow path 50 is relatively warm and, thus, warms the housing 24 of the compressor 14. This prevents condensation from forming on the housing 24 of the compressor 14, which protects adjacent electronic components.

The compressor 14, and associated HVAC chiller system, is configured to provide a relatively high capacity. In one example, the compressor 14 provides a capacity of at least about 60 refrigeration tons (or 60 RT, which is about 720,000 BTU/hour). In one particular example, the capacity of the compressor 14 is between about 60 and 1,000 RT (between about 720,000 and 12,000,000 BTU/hour). In a further example, the capacity of the compressor 14 is about 80 RT (about 960,000 BTU/hour). This relatively increased capacity can be compared with axial flow compressors that are used in residential refrigerators operating under vastly different conditions, which are on the order of 0.01 RT (120 BTU/hour).

The compressor 14 thus provides an increased capacity while reducing shaft loads, which leads to a more compact compressor design while lowering power consumption. In one particular example, the compressor 14 lowers power consumption by about 75% relative to known chiller compressors. The compressor 14 is also scalable and can be sized to fit a number of relatively large-duty refrigeration applications outside of chillers.

It should be understood that terms such as "axial" and "radial" are used above with reference to the normal operational attitude of a compressor. Further, these terms have been used herein for purposes of explanation, and should not be considered otherwise limiting. Terms such "about" are not intended to be boundaryless terms, and should be interpreted consistent with the way one skilled in the art would interpret those terms.

Although the different examples have the specific components shown in the illustrations, embodiments of this disclosure are not limited to those particular combinations. It is possible to use some of the components or features from one of the examples in combination with features or components from another one of the examples.

One of ordinary skill in this art would understand that the above-described embodiments are exemplary and non-limiting. That is, modifications of this disclosure would come within the scope of the claims. Accordingly, the following claims should be studied to determine their true scope and content.

The invention claimed is:

1. An axial flow refrigerant compressor, comprising:

an inlet and an outlet arranged along a main refrigerant flow path;

at least one compression stage having an impeller with a plurality of blades configured to rotate about an axis of rotation, wherein refrigerant flowing from the inlet to the outlet principally flows in a direction parallel to the axis of rotation and such that refrigerant flowing downstream of the compression stage flows to an outlet of the refrigerant compressor in the direction parallel to the axis of rotation;

an electric motor arranged upstream of the impeller in the main refrigerant flow path; and a recirculation flow path including a plurality of valves, wherein each of the plurality of valves are configured to selectively introduce refrigerant from the recirculation flow path into the main refrigerant flow path at a respective location, and wherein each of the locations are axially spaced-apart from one another.

2. The axial flow refrigerant compressor as recited in claim 1, wherein the plurality of valves are controlled by a control unit.

3. The axial flow refrigerant compressor as recited in claim 2, wherein the electric motor is controlled by the control unit.

* * * * *